US011563263B2

(12) United States Patent
Toonoe et al.

(10) Patent No.: US 11,563,263 B2
(45) Date of Patent: Jan. 24, 2023

(54) GLASS ANTENNA FOR CIRCULARLY POLARIZED WAVE RECEPTION

(71) Applicant: Central Glass Company, Limited, Ube (JP)

(72) Inventors: Kazuhito Toonoe, Matsusaka (JP); Kanya Hirabayashi, Matsusaka (JP)

(73) Assignee: Central Glass Company, Limited, Ube (JP)

( * ) Notice: Subject to any disclaimer, the term of this patent is extended or adjusted under 35 U.S.C. 154(b) by 141 days.

(21) Appl. No.: 17/058,476

(22) PCT Filed: May 9, 2019

(86) PCT No.: PCT/JP2019/018480

§ 371 (c)(1),
(2) Date: Nov. 24, 2020

(87) PCT Pub. No.: WO2019/225321

PCT Pub. Date: Nov. 28, 2019

(65) Prior Publication Data

US 2021/0203055 A1 Jul. 1, 2021

(30) Foreign Application Priority Data

May 25, 2018 (JP) ..... JP2018-100104

(51) Int. Cl.
*H01Q 1/12* (2006.01)
*H01Q 1/32* (2006.01)

(52) U.S. Cl.
CPC ..... *H01Q 1/1271* (2013.01); *H01Q 1/325* (2013.01)

(58) Field of Classification Search
CPC ..... H01Q 1/325; H01Q 1/1271; H01Q 5/378
See application file for complete search history.

(56) References Cited

U.S. PATENT DOCUMENTS

2007/0080876 A1 4/2007 Kagaya et al.
2010/0231468 A1* 9/2010 Ogino ..... H01Q 1/325 343/870

(Continued)

FOREIGN PATENT DOCUMENTS

EP 3 611 795 A1 2/2019
JP 2007-124630 A 5/2007

(Continued)

OTHER PUBLICATIONS

Takeyasu et al. (JP 2013/198090), machine translation. (Year: 2013).*

(Continued)

*Primary Examiner* — Awat M Salih
(74) *Attorney, Agent, or Firm* — Crowell & Moring LLP

(57) ABSTRACT

Provided is a glass antenna having an improved circularly polarized wave reception bandwidth in a frequency range from 1 to 2 GHz. The glass antenna has a core-side feeding part, a ground-side feeding part arranged adjacent to the core-side feeding part, a first element extending from the ground-side feeding part, and a parasitic element including a first wire, a second wire arranged parallel or substantially parallel to the first wire and a third wire connecting the first and second wires. The parasitic element is disposed to surround the core-side and ground-side feeding parts between an edge of a metal body part adjacent to the core-side and ground-side feeding parts and the third wire. A blank portion is provided between the parasitic element and the first element such that the parasitic element and the first element allow resonance with a radio wave in any arbitrary frequency band within the frequency range.

21 Claims, 5 Drawing Sheets

(56) References Cited

U.S. PATENT DOCUMENTS

| | | | | |
|---|---|---|---|---|
| 2016/0306050 | A1 | 10/2016 | Shingyoji | |
| 2019/0312341 | A1 | 10/2019 | Tonoe et al. | |
| 2019/0319334 | A1* | 10/2019 | Dai | H01Q 1/1271 |

FOREIGN PATENT DOCUMENTS

| | | | | |
|---|---|---|---|---|
| JP | 2009-118268 | A | 5/2009 | |
| JP | 2011-151624 | A | 8/2011 | |
| JP | 2013-198090 | A | 9/2013 | |
| JP | 2016-205881 | A | 12/2016 | |
| KR | 10-2011-0105724 | A | 9/2011 | |
| WO | WO-02056412 | A2 * | 7/2002 | H01Q 1/1278 |

OTHER PUBLICATIONS

Supplementary European Search Report issued in European Application No. 19806458.6 dated Jun. 25, 2021 (fourteen (14) pages).
International Search Report (PCT/ISA/210) issued in PCT Application No. PCT/JP2019/018480 dated Jun. 18, 2019 with English translation (two (2) pages).
Japanese-language Written Opinion (PCT/ISA/237) issued in PCT Application No. PCT/JP2019/018480 dated Jun. 18, 2019 (three (3) pages).

* cited by examiner

GLASS ANTENNA FOR CIRCULARLY POLARIZED WAVE RECEPTION

FIELD OF THE INVENTION

The present invention relates to a glass antenna for receiving a circularly polarized wave in a frequency range from 1 GHz to 2 GHz.

BACKGROUND ART

In vehicles such as automobiles, satellite positioning systems typified by GPS have been used. The satellite positioning system requires an antenna capable of receiving, from GPS satellites, circularly polarized waves in the L1 (1.575 GHz) frequency band. As an example of the antenna for receiving such circularly polarized waves, there is known a glass antenna which has a rectangular shape as a whole and includes a loop-shaped antenna element, a parasitic element and a conductor arranged surrounding these elements as disclosed in Patent Document 1.

Furthermore, the use of multiple satellite positioning systems, that is, the use of circularly polarized waves in multiple frequency bands have recently been proposed to implement a higher-precision positioning system. For example, Patent Document 2 discloses a system unit which has an antenna adapted to a first positioning mode using a GPS satellite and an antenna adapted to a second positioning mode using a GLONASS satellite.

PRIOR ART DOCUMENTS

Patent Documents

Patent Document 1: Japanese Laid-Open Patent Publication No. 2009-118268

Patent Document 2: Japanese Laid-Open Patent Publication No. 2016-205881

SUMMARY OF THE INVENTION

Problems to be Solved by the Invention

In the case where a satellite positioning system unit using circularly polarized waves in multiple frequency bands is implemented in a vehicle, it is not practical to provide antennas adapted to the respective frequency bands because of the limited installation space for the antennas in the vehicle. In order to implement such a satellite positioning system unit in the vehicle, it is useful to provide a glass antenna capable of receiving multiple circularly polarized waves in a frequency range from 1 GHz to 2 GHz.

In view of the foregoing, it is an object of the present invention to provide a glass antenna with an improved circularly polarized wave reception bandwidth so as to receive circularly polarized waves in multiple arbitrary frequency bands within a frequency range of 1 GHz to 2 GHz.

Means for Solving the Problems

According to one aspect of the present invention, there is provided a glass antenna for receiving a circularly polarized wave in an arbitrary frequency band within a frequency range from 1 GHz to 2 GHz, the glass antenna being configured for mounting to a window glass of a vehicle and comprising a metal body part of the vehicle as an antenna element, the glass antenna comprising:

a core-side feeding part;

a ground-side feeding part arranged adjacent to the core-side feeding part;

a first element extending from the ground-side feeding part; and a parasitic element including a first wire, a second wire arranged parallel to or substantially parallel to the first wire and a third wire connecting the first wire and the second wire to each other, wherein the parasitic element is disposed to surround the core-side and ground-side feeding parts at a position between an edge of the metal body part located adjacent to the core-side and ground-side feeding parts and the third wire, wherein the core-side feeding part is disposed in an area surrounded by the first wire, the third wire, the first element, the ground-side feeding part and the edge of the metal body part, wherein a blank portion is provided between the parasitic element and the first element such that the parasitic element and the first element allows resonance with a radio wave in any arbitrary frequency band within the frequency range, and wherein, when the window glass is mounted to the vehicle,

- a first end of the first wire located away from the third wire and the edge of the metal body part are disposed with a blank portion provided therebetween in an in-plane direction of the window glass of the vehicle such that the first end of the first wire and the metal body part are in a positional relationship that allows resonance with a radio wave in any arbitrary frequency band within the frequency range;
- a second end of the second wire located away from the third wire and the edge of the metal body part are disposed without a blank portion provided therebetween in the in-plane direction of the window glass of the vehicle, or are disposed with a blank portion provided therebetween in the in-plane direction of the window glass of the vehicle such that the second end of the second wire and the metal body part are in a positional relationship that allows resonance with a radio wave in any arbitrary frequency band within the frequency range; and
- a blank portion is provided between the ground-side feeding part and the metal body part of the vehicle such that the ground-side feeding part and the metal body part of the vehicle allow resonance with a radio wave in any arbitrary frequency band within the frequency range.

This glass antenna attains at least three routes for reception of circularly polarized waves.

The first route is as follows: the ground-side feeding part→the first element→the blank portion between the first element and the parasitic element→the parasitic element→the blank portion between the first end of the parasitic element and the metal body part→the metal body part→the blank portion between the metal body part and the ground-side feeding part→the ground-side feeding part.

The second route is as follows: the ground-side feeding part→the first element→the blank portion between the first element and the parasitic element→the parasitic element→the second end of the parasitic element→the metal body part→the blank portion between the metal body part and the ground-side feeding part→the ground-side feeding part.

The third route is as follows: the ground-side feeding part→the blank portion between the metal body part and the ground-side feeding part→the metal body part→the second end of the parasitic element→the parasitic element→the blank portion between the first end of the parasitic element and the metal body part→the metal body part→the blank portion between the metal body part and the ground-side feeding part→the ground-side feeding part.

In the first to third routes, the first end and the metal body part are disposed via the blank portion; and the second end and the metal body part are disposed via the blank portion or are connected directly.

Each of these routes allows flow of electric signals in a forward direction or reverse direction of the arrows (→). Wirings are connected to the ground-side feeding part and the core-side feeding part through a connector etc. The core-side wiring for connection to any equipment for an amplifier, a navigation system etc. is connected to the core-side feeding part. Within the connector, the electric signal is coupled to the core-side element in a high-frequency manner or is coupled from the ground-side feeding part to the core-side feeding part in a high-frequency manner. The electric signal is hence transmitted to the equipment.

The third route is adaptable to lower frequencies than the first and second routes so as to execute radio wave reception in a lower frequency band within the frequency range of 1 to 2 GHz. The first and second routes are adaptable to higher frequencies than the third route so as to execute radio wave reception in a higher frequency band within the frequency range of 1 to 2 GHz.

In each route, the blank portion sets some spacing that allows resonance with a desired radio wave in the frequency range of 1 to 2 GHz. With such spacing, the design for reception of circularly polarized waves in multiple arbitrary frequency bands is made easy. The glass antenna thus achieves a high reception sensitivity for circularly polarized waves in multiple arbitrary frequency bands.

It is considered from the above reasons that the glass antenna according to one aspect of the present invention efficiently receives circularly polarized waves in multiple frequency bands.

In view of this, it is preferable that both of the first and second ends are in a positional relationship with the metal body part so as to allow resonance with a radio wave in any arbitrary frequency band within the frequency range, that is, the blank portions are respectively provided between the first end and the metal body part and between the second end and the metal body part in the in-plane direction of the vehicle window glass.

According to another aspect of the present invention, there is provided a window glass structure for a vehicle, comprising: the above-mentioned glass antenna.

More specifically, the vehicle window glass structure is provided with the vehicle window glass, the metal body part and the glass antenna. The glass structure is formed in which a peripheral edge portion of the window glass is bonded to the metal body part by an adhesive.

Effects of the Invention

The glass antenna according to the present invention has an improved bandwidth for reception of circularly polarized waves in the frequency range from 1 GHz to 2 GHz, and thus can suitably be applied to a vehicular positioning system unit using multiple satellite positioning systems. In particular, the glass antenna according to the present invention can suitably be applied to a vehicular positioning system unit using multiple satellite positioning systems associated with GPS satellites in the L1 frequency band because the glass antenna easily receives circularly polarized waves in the 1.575 GHz frequency band with good sensitivity.

DETAILED DESCRIPTION OF EMBODIMENTS

Figure 1:
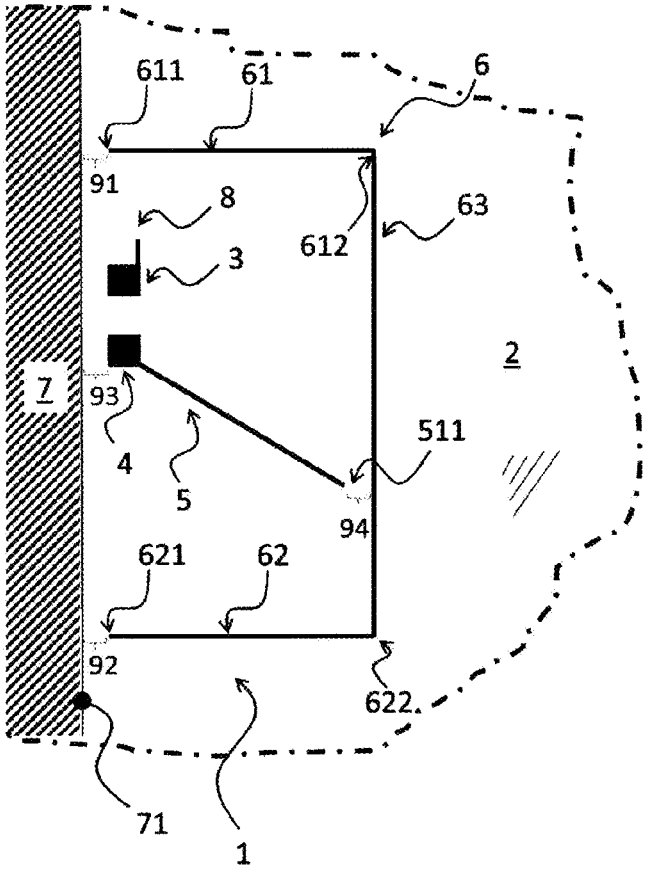
FIG. 1 is a schematic view of a main part of a glass antenna according to a typical embodiment of the present invention.

A glass antenna 1 according to one embodiment of the present invention will be described in detail below with reference to the drawings. FIG. 1 is a schematic view of a main part of the glass antenna 1 according to one typical embodiment of the present invention. More specifically, FIG. 1 shows a state where the glass antenna 1 is mounted to a vehicle windshield as visually seen from the exterior side. A vertical side edge of a metal body part 7 shown in the left side of FIG. 1 corresponds to a left-side A-pillar as seen from the exterior side. In an embodiment other than the typical embodiment of FIG. 1, the edge 71 of the metal body part 71 (shown as a vertical side edge in FIG. 1) may correspond to a right-side A-pillar as seen from the exterior side or correspond to a metal part of a window frame disposed on an upper side or lower side of the vehicle window glass 2. The glass antenna 1 of FIG. 1 is suitable for receiving right-handed circularly polarized waves as seen from the interior side. In the case of receiving left-handed circularly polarized waves as seen from the interior side, the antenna pattern is reversed upside down with respect to the glass antenna 1 of FIG. 1.

The glass antenna 1 is configured to receive circularly polarized waves in a frequency range of 1 to 2 GHz by being mounted to the vehicle window glass 2. The glass antenna 1 has the metal body part 7 as an antenna element, and also has a core-side feeding part 3, a ground-side feeding part 4 arranged adjacent to the core-side feeding part 3, a first element 5 extending from the ground-side feeding part 4 and a parasitic element 6 including a first wire 61, a second wire 62 extending parallel to or substantially parallel to the first wire 61 and a third wire 63 connecting the first wire 61 and the second wire 62 to each other. The parasitic element 6 is disposed to surround the core-side and ground-side feeding parts 3 and 4 at a position between the edge of the metal body part 7 located adjacent to the core-side and ground-side feeding parts 3 and 4 and the third wire 63. The core-side feeding part 3 is disposed in an area surrounded by the first wire, the third wire, the first element, the earth-side feeding part and the edge 71 of the metal body part. In FIG. 1, the parasitic element 6 is U-shaped when viewed in a direction toward the window glass from the exterior side.

As to the relationship of the core-side feeding part 3 and the ground-side feeding part 4, the wording "adjacent" means that there is a distance at which core-side and ground-side terminals of a connector can be respectively connected to the corresponding feeding parts 3 and 4 or there is a distance at which an electric signal passing through the glass antenna 1 can be coupled from one feeding part to the other feeding part in a high-frequency manner. In the case where each of the core-side feeding part 3 and the ground-side feeding part 4 has an area of 15 to 100 $mm^2$, for example, the spacing between these feeding parts may be 3 mm to 10 mm. Further, the arrangement direction of the core-side feeding part 3 and the ground-side feeding part 4 may be parallel to or substantially parallel to the edge 71.

A blank portion 94 is provided between the first element 5 and the parasitic element 6 such that the first element 5 and the parasitic element 6 are in a positional relationship that allows resonance with any arbitrary radio wave in the above-mentioned frequency range. For high-frequency coupling, it is preferable that the blank portion 94 is defined by a free end 511 of the first element 5 and the parasitic element 6. A length of the blank portion 94 can be adjusted within the range of 1 mm to $\lambda_{(1)}\times0.5\times\alpha$ (where $\lambda_{(1)}$ is an arbitrary wavelength in a free space within the above-mentioned frequency range; and $\alpha$ is a wavelength shortening coefficient of glass and is taken as 0.7) so as to allow resonance with any radio wave in the above-mentioned frequency range.

Figure 2:
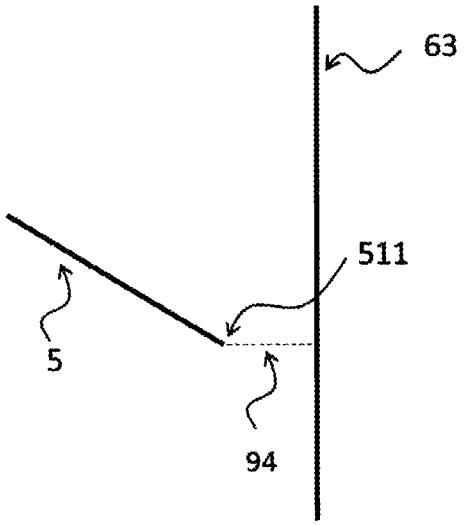
FIG. 2 is a schematic view for explaining the definition of a blank portion in the glass antenna according to the present invention.

Herein, the definition of a blank portion in the glass antenna according to the present embodiment will be explained below with reference to FIG. 2. FIG. 2 is a schematic view for explaining the definition of the blank portion in the glass antenna according to the present embodiment. In this figure, the blank portion 94 is shown as a typical example of the blank portion. The blank portion refers to a portion where no antenna element exists between one antenna element and another antenna element located closest thereto as indicated by a broken line in FIG. 2. A length of the blank portion is a minimum distance between one antenna element and another antenna element located nearest thereto as indicated by a broken line in FIG. 2. In the present embodiment, the metal body part 7 is also regarded as the antenna element as mentioned above.

It is preferable that the first element 5 is arranged extending toward the third wire 63. In such an arrangement, it becomes easy to distinguish the difference between the distance of the first/second route and the distance of the third route. This contributes to an improvement in the bandwidth for reception of circularly polarized waves in the frequency range of 1 GHz to 2 GHz.

In a state that the window glass 2 is mounted to the vehicle, the core-side feeding part 3 and the ground-side feeding part 4 are disposed between the edge 71 of the metal body part 7 located adjacent to these feeding parts and the third wire 63. A blank portion 93 is provided between the metal body part 7 and the ground-side feeding part 4 such that the ground-side feeding part 4 and the metal body part 7 are in a positional relationship that allows resonance with any arbitrary radio wave in the above-mentioned frequency range. A length of the blank portion 93 can be adjusted within the range of e.g. 5 mm to $\lambda_{(1)}\times0.5$ so as to allow resonance with any radio wave in the above-mentioned frequency range. In terms of improvement in the reception sensitivity for circularly polarized waves, it is preferable that the third wire 63 is arranged parallel to or substantially parallel to the edge 71 of the metal body part 7 located adjacent to the core-side and ground-side feeding parts 3 and 4.

A distance and sizes of the ground-side feeding part 4 and the core-side feeding part 3 are set according to the shape of the corrector connected to these feeding parts. The distance of the feeding parts may be set to 5 mm to 30 mm. The size of the feeding part may be set to 25 $mm^2$ to 360 $mm^2$. The distance between the core-side feeding part 3 and the edge 71 of the metal body part 7 located adjacent to the core-side feeding part 3 can be the same as the length of the blank portion 93.

In the present embodiment of FIG. 1, each of a first end 611 of the first wire 61 located away from the third wire 63 and a second end 621 of the second wire 62 located away from the third wire 63 and the edge 71 of the metal body part 71 are disposed with a blank portion provided therebetween in an in-plane direction of the vehicle window glass such that, in a state that the window glass 2 is mounted to the vehicle, the end 611, 621 of the wire 61, 62 and the metal body part 7 are in a positional relationship that allows resonance with any radio wave in the above-mentioned frequency range. A length of the blank portion 91 between the first end 611 and the edge 71 of the metal body part 7 and a length of the blank portion 92 between the second end 621 and the edge 71 of the metal body part 7 can be each adjusted within the range of 5 mm to $\lambda_{(1)}\times0.5$ so as to allow resonance with any radio wave in the above-mentioned frequency range. In the case where no blank portion is provided between the second end and the edge of the metal body part in the in-plane direction of the vehicle window glass, there is a spacing between the vehicle window glass 2 and the metal body part 7 so as to allow resonance with a radio wave in the above-mentioned frequency range on the basis of the spacing. The spacing is set to, for example, 3 to 7 mm.

Preferably, the glass antenna 1 has a second element 8 extending from the core-side feeding part 3. The second element 8 is in a positional relationship with the parasitic element and the metal body part so as not to allow resonance with a radio wave in the above-mentioned frequency range. For example, the second element 8 can be of linear shape, L-shape or the like. The arrangement of such a second element 8 enables fine adjustment of the reception band. A length of the second element 8 can be adjusted within the range of 5 mm to 50 mm.

In the parasitic element 6, it is preferable that: a minimum distance (III) between a first connection point 612 at which the first wire 61 and the third wire 63 are connected to each other and a second connection point 622 at which the second wire 62 and the third wire 63 are connected to each other is in the range of ±25% of $(0.5\times\lambda_{(2)}\times\alpha)\times A$; and a minimum distance (I) between the first connection point 612 and the edge 71 of the metal body part 7 and a minimum distance (II) between the second connection point 622 and the edge 71 of the metal body part 7 are each in the range of $(0.25\times\lambda_{(2)}\times\alpha)$ to $(0.5\times\lambda_{(1)}\times\alpha)$ (where $\lambda_{(2)}$ is an arbitrary wavelength in a free space within the above-mentioned frequency range and satisfies a relationship of $\lambda_{(1)}>\lambda_{(2)}$; and A is an integer of 1 to 3). When the lengths of the respective element parts of the parasitic element 6 and the positional relationship between the parasitic element 6 and the edge 71 of the metal body part 7 are adjusted to satisfy the above ranges, it is possible to easily improve the appearance shape of the glass antenna 1 and the bandwidth for reception of circularly polarized waves in the frequency range of 1 GHz to 2 GHz.

Further, it is preferable that the minimum distance (III) between the first connection point 612 and the second connection point 622, the minimum distance (I) between the first connection point 612 and the edge 71 of the metal body part 7 and the minimum distance (II) between the second connection point 622 and the edge 71 of the metal body part 7 are in a relationship of (I)+(II)>(III). By satisfaction of such a relationship, the lengths of long and short axes of the electromagnetic field generated in the glass antenna 1 are made closer to each other so that it is possible to easily improve the reception sensitivity for circularly polarized wave.

Figure 3:
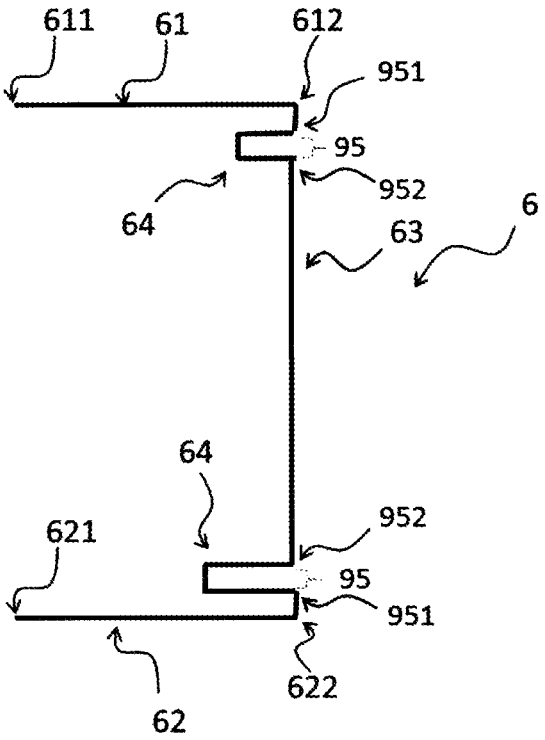
FIG. 3 is a schematic view showing a derivative example of a parasitic element in the glass antenna according to the present invention.

Furthermore, it is preferable that the parasitic element 6 includes at least one bent-shaped detour wire 64 arranged in an area surrounded by the first wire 61, the second wire 62 and the third wire 63 as shown as a derivative example of the parasitic element in FIG. 3. With this configuration, it is possible to easily improve the bandwidth for reception of circularly polarized waves.

In the case where the parasitic element 6 has a detour wire 64, it is preferable in terms of appearance improvement that the detour wire 64 is formed to make a detour in a direction perpendicular to a line from which any of the first wire 61, the second wire 62 and the third wire 63 starts and on a side where the feeding parts 3 and 4 are surrounded by the parasitic element 6.

It is also preferable that: starting and end points 951 and 952 of the detour wire (provided that the starting point is an end of the detour wire closer to the connection point 612, 622) are disposed on a route of the minimum distance (III) between the first connection point and the second connection point, the minimum distance (I') between the first connection point and the first end and the minimum distance (II') between the second connection point and the second end; and the starting and end points 951 and 952 of the detour wire 64 are in a positional relationship that allows resonance with any radio wave in the above-mentioned frequency range. A length of the spacing between these starting and end points along the minimum distance route can be adjusted within the range of 1 mm to $\lambda_{(1)}\times 0.5\times\alpha$. When the parasitic element 6 has such a configuration, it is possible to widen the width of the reception band. In terms of appearance, the connection point 612, 622 and the starting point 951 are preferably located close to each other. For example, the distance between the connection point and the starting point may be adjusted within the range of 3 mm to 20 mm.

The respective elements and feeding parts can be formed on a surface of the vehicle window glass 2 by using a conductive ceramic paste or the like. The ceramic paste is patterned onto the surface of the window glass by screen printing etc. and fired by a heating furnace or the like so that the ceramic pattern is fixed as the pattern of the glass antenna. Alternatively, a light-transparent resin film on which the antenna elements are formed may be adhered to the glass surface. Among the elements of the glass antenna, the width of the linear element may be adjusted to about 0.5 mm to 1 mm.

Any or each of the elements of the glass antenna may be formed on a black frame of a peripheral edge portion of the vehicle window glass 2.

A curved, trapezoidal or rectangular glass plate is used as the vehicle window glass 2. The glass plate can be of either single plate glass or laminated glass. Further, the glass plate can be of either strengthened glass or non-strengthened glass. As the window glass 2, usable is a glass plate formed of soda-lime silicate glass by a float method according to ISO 16293-1 and generally used as a glass plate for a vehicle. The glass plate may be colorless or colored

EXAMPLES

Example 1

A glass antenna 1 shown in FIG. 1 was prepared. In this Example, the sizes etc. of the respective elements were set as follows.

<Core-Side Elements>

Size of core-side feeding part 3: 12 mm×10 mm

Second element 8: linear shape of 5 mm in length

<Ground-Side Elements>

Size of ground-side feeding part 4: 12 mm×10 mm

The core-side feeding part 3 and the ground-side feeding part 4 were arranged to maintain a parallel positional relationship with the edge 71 of the metal body part 7.

Length of blank portion 93: 10 mm

First Element 5:

The first element was arranged to extend at an angle of 45 degrees with respect to the third wire 63 of the parasitic element 6; and the length of the first element was set to 27 mm.

Length of blank portion 94: 4 mm

<Parasitic Element>

First wire 61: linear shape of 25 mm in length

Second wire 62: linear shape of 25 mm in length

Third wire 63: linear shape of 80 mm in length

The first wire 61 and the second wire 62 were arranged parallel to each other; and the third wire 63 was arranged parallel to the edge 71 of the metal body part 7. The parasitic element was thus formed in a U-shape where the core-side feeding part 3 and the ground-side feeding part 4 were surrounded by the first, second and third wires. The minimum distance between the first connection point 611 and the second connection point 622 was set to 80 mm.

Length of blank portion 91: 20 mm

The minimum distance between the first connection point 611 and the edge 71 of the metal body part 7 was set to 45 mm.

Length of blank portion 92: 20 mm

The minimum distance between the second connection point 622 and the edge 71 of the metal body part 7 was set to 45 mm.

Example 2

A glass antenna having the same pattern structure as that of Example 1 was prepared, except that: the length of the second wire 62 was set to 45 mm; and the blank portion 92 was not provided.

Example 3

Figure 4:
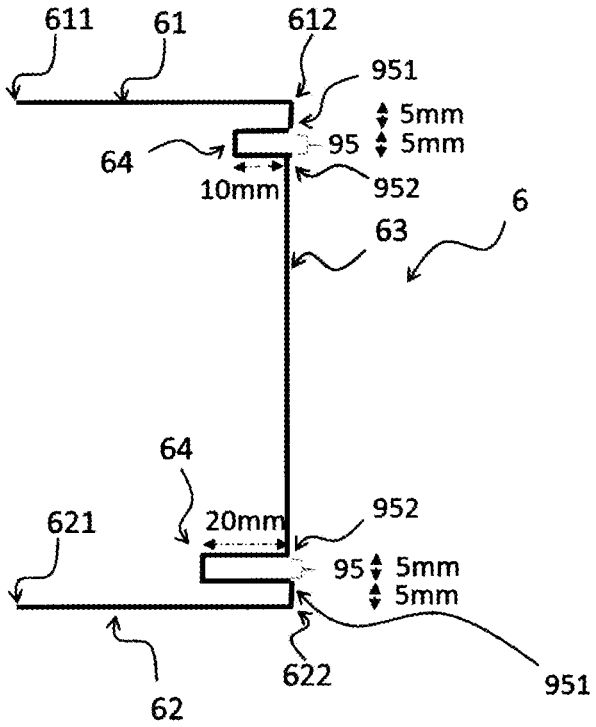
FIG. 4 is a schematic view for explaining the size of a detour wire of a parasitic element in Example 2.

A glass antenna having the same pattern structure as that of Example was prepared, except that: the parasitic element 6 was configured in the form of the derivative example shown in FIG. 3; and the length of the first wire 61 and the length of the second wire 62 were set to 35 mm. In this Example, the length and position of the spacing 95 of the detour wire 64 of the parasitic element 6 were set as shown in FIG. 4.

Comparative Example 1

A glass antenna having the same pattern structure as that of Example 1 was prepared, except that: the length of the first element 5 was set to 33 mm; and the blank portion 94 was no provided.

Comparative Example 2

A glass antenna having the same pattern structure as that of Example 1 was prepared, except that: the length of the first wire 61 was set to 45 mm; and the blank portion 91 was not provided.

Comparative Example 3

A glass antenna having the same pattern structure as that of Example 1 was prepared, except that: the length of the first wire 61 and the length of the second wire 62 were both set to 45 mm; and the blank portions 91 and 92 were not provided.

Results of Respective Examples and Comparative Examples

Figure 5:
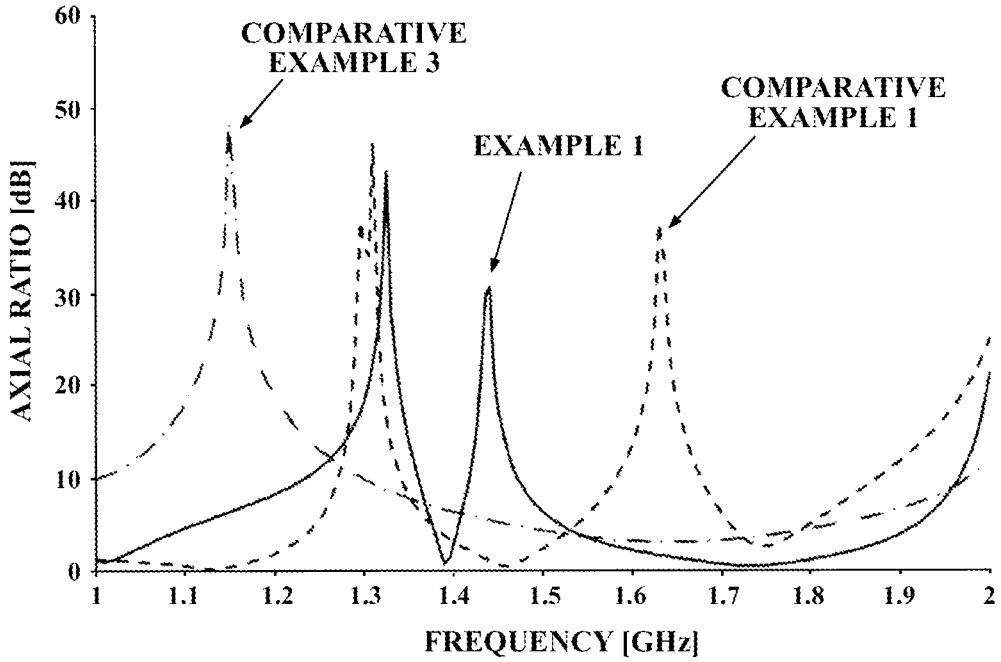
FIG. 5 is a diagram showing reception characteristics of glass antennas according to Example 1 and Comparative Examples 1 and 3.
Figure 6:
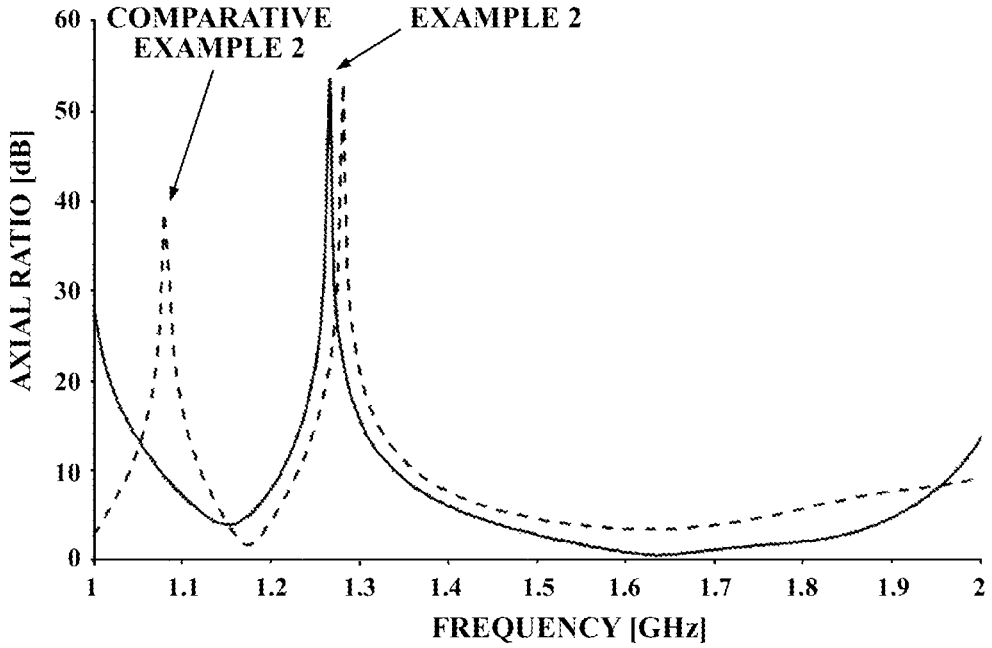
FIG. 6 is a diagram showing reception characteristics of glass antennas according to Example 2 and Comparative Example 2.
Figure 7:
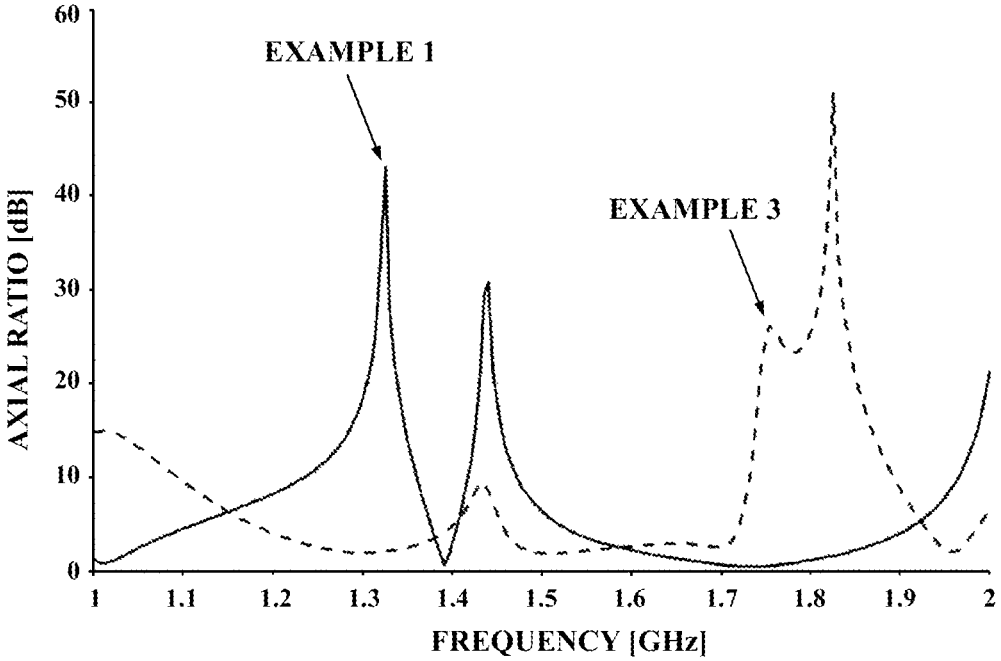
FIG. 7 is a diagram showing reception characteristics of glass antennas according to Examples 1 and 3.

The axial ratios of polarized waves received in the range of 1 GHz to 2 GHz in the respective Examples and Comparative Examples are shown in FIGS. 5 to 7. Herein, attentions are focused on the bands whose bandwidth was 0.25 GHz or greater at the axial ratio of 4 dB or lower and which included a region where the axial ratio became 2 dB or lower. In Example 1, the band of 4 dB or lower ranged from 1.54 GHz to 1.9 GHz; and the band of 2 dB or lower ranged from 1.61 GHz to 1.85 GHz. In Example 2, the band of 4 dB or lower ranged from 1.46 GHz to 1.88 GHz; and the band of 2 dB or lower ranged from 1.54 GHz to 1.8 GHz. In Example 3, the band of 4 dB or lower ranged from 1.46 GHz to 1.72 GHz; and the band of 2 dB or lower ranged from 1.49 GHz to 1.54 GHz. In each Comparative Example, by contrast, there were seen no bands having a bandwidth of 0.25 GHz or greater at the axial ratio of 4 dB or lower and including a region where the axial ratio was 2 dB or lower. With respect to circularly polarized waves in the 1.575 GHz band, the antenna gain in the maximum radiation direction was 1.2 dBic in Example 1; and the antenna gain in the maximum radiation direction was 1.7 dBic in Example 3.

It has thus been shown that the glass antenna according to the above-mentioned embodiment of the present invention has an improved bandwidth for reception of circularly polarized waves in the frequency range from 1 GHz to 2 GHz.

DESCRIPTION OF REFERENCE NUMERALS

1: Glass antenna
2: Vehicle window glass
3: Core-side feeding part
4: Ground-side feeding part
5: First element
6: Parasitic element
61: First wire
611: First end
612: First connection point
62: Second wire
621: Second end
622: Second connection point
63: Third wire
64: Detour wire
7: Metal body part
8: Second element
91: First blank portion
92: Second blank portion
93: Third blank portion
94: Fourth blank portion

The invention claimed is:

1. A window glass structure of a vehicle, comprising:

a window glass mounted to the vehicle; and a glass antenna arranged on the window glass and configured to receive a circularly polarized wave in an arbitrary frequency band within a frequency range of 1 GHz to 2 GHz, the glass antenna comprising:

a metal body part of the vehicle as an antenna element;

a core-side feeding part to which a core wiring for connection to vehicle equipment is connected;

a ground-side feeding part arranged adjacent to the core-side feeding part and to which a ground wiring is connected;

a first element extending from the ground-side feeding part; and a parasitic element including a first wire, a second wire arranged parallel to or substantially parallel to the first wire and a third wire connecting the first wire and the second wire to each other, wherein the parasitic element is disposed to surround the core-side and ground-side feeding parts at a position between an edge of the metal body part located adjacent to the core-side and ground-side feeding parts and the third wire, wherein the core-side feeding part is disposed in an area surrounded by the first wire, the third wire, the first element, the ground-side feeding part and the edge of the metal body part, wherein a first blank portion where no antenna element exists is provided between the parasitic element and the first element such that the parasitic element and the first element allow resonance with a radio wave in any arbitrary frequency band within the frequency range;

wherein a first end of the first wire located away from the third wire and the edge of the metal body part are disposed with a second blank portion where no antenna element exists being provided therebetween in an in-plane direction of the window glass of the vehicle such that the first end of the first wire and the metal body part are in a positional relationship that allows resonance with a radio wave in any arbitrary frequency band within the frequency range;

wherein a second end of the second wire located away from the third wire and the edge of the metal body part are disposed without a blank portion where no antenna element exists being provided therebetween in the in-plane direction of the window glass of the vehicle, or are disposed with a third blank portion where no antenna element exists being provided therebetween in the in-plane direction of the window glass of the vehicle such that the second end of the second wire and the metal body part are in a positional relationship that allows resonance with a radio wave in any arbitrary frequency band within the frequency range; and wherein a fourth blank portion where no antenna element exists is provided between the ground-side feeding part and the metal body part of the vehicle such that the ground-side feeding part and the metal body part of the vehicle allow resonance a radio wave in any arbitrary frequency band within the frequency range.

2. The window glass structure according to claim 1, wherein the first element extends toward the third wire, and wherein the first blank portion is provided between a free end of the first element and the parasitic element.

3. The window glass structure according to claim 2, wherein the first element is arranged to extend at an angle of 45 degrees with respect to the third wire.

4. The window glass structure according to claim 1, wherein the first element and the parasitic element are in a positional relationship that allows resonance with a radio wave in any arbitrary frequency band within the frequency range.

5. The window glass structure according to claim 1, comprising a second element extending from the core-side feeding part, wherein the second element, the parasitic element and the metal body part are in a positional relationship that does not allow resonance with a radio wave in the frequency range.

6. The window glass structure according to claim 5, wherein the second element is of linear shape or L-shape.

7. The window glass structure according to claim 1, wherein, in the parasitic element, a minimum distance (III) between a first connection point at which the first wire and the third wire are connected to each other and a second connection point at which the second wire and the third wire are connected to each other is in a range of ±25% of $(0.5\times\lambda_{(2)}\times\alpha)\times A$, and a minimum distance (I) between the first connection point and the metal body part and a minimum distance (II) between the second connection point and the metal body part are each in a range of $(0.25\times\lambda_{(2)}\times\alpha)$ to $(0.5\times\lambda_{(1)}\times\alpha)$, where $\alpha$ is a wavelength shortening coefficient of glass and is taken as 0.7; $\lambda_{(1)}$ and $\lambda_{(2)}$ are each an arbitrary wavelength in a free space within the frequency range and satisfy a relationship of $\lambda_{(1)}>\lambda_{(2)}$; and A is an integer of 1 to 3.

8. The window glass structure according to claim 1, wherein a minimum distance (III) between a first connection point at which the first wire and the third wire are connected to each other and a second connection point at which the second wire and the third wire are connected to each other, a minimum distance (I) between the first connection point and the metal body part and a minimum distance (II) between the second connection point and the metal body part satisfy a relationship of (I)+(II)>(III).

9. The window glass structure according to claim 1, wherein the parasitic element has a detour wire formed in a bent shape and arranged in an area surrounded by the first wire, the second wire and the third wire, wherein starting and end points of the detour wire are disposed on a route of a minimum distance (III) between a first connection point at which the first wire and the third wire are connected to each other and a second connection point at which the second wire and the third wire are connected to each other, a minimum distance (I') between the first connection point and the first end and a minimum distance (II') between the second connection point and the second end, and wherein the starting and end points are in a positional relationship that allows resonance with a radio wave in any arbitrary frequency band within the frequency range.

10. The window glass structure according to claim 1, wherein the first and second ends are disposed with a fifth blank portion provided between each of the first and second ends and the metal body part in the in-plane direction of the window glass such that each of the first and second ends and the metal body part are in a positional relationship that allows resonance with a radio wave in any arbitrary frequency band within the frequency range.

11. A vehicle, comprising the window glass structure according to claim 1.

12. The window glass structure according to claim 1, wherein an arrangement direction of the core-side feeding part and the ground-side feeding part is parallel to or substantially parallel to the edge of the metal body part.

13. The window glass structure according to claim 1, wherein a length of the first blank portion between the parasitic element and the first element is adjusted within a range of 1 mm to $\lambda_{(1)}\times0.5\times\alpha$ where $\lambda_{(1)}$ is an arbitrary wavelength in a free space within the frequency range; and $\alpha$ is a wavelength shortening coefficient of glass and is taken as 0.7.

14. The window glass structure according to claim 1, wherein a length of the fourth blank portion between the ground-side feeding part and the metal body part is adjusted within a range of 5 mm to $\lambda_{(1)}\times0.5$ where $\lambda_{(1)}$ is an arbitrary wavelength in a free space within the frequency range.

15. The window glass structure according to claim 1, wherein the third wire is arranged parallel to or substantially parallel to the edge of the metal body part located adjacent to the core-side and ground-side feeding parts.

16. The window glass structure according to claim 1, wherein a distance of the core-side and ground-side feeding parts is 5 mm to 30 mm.

17. The window glass structure according to claim 1, wherein each of the core-side and ground-side feeding parts has a size of 25 $mm^2$ to 360 $mm^2$.

18. The window glass structure according to claim 1, wherein a length of the second blank portion between the first end of the first wire and the edge of the metal body part and a length of the third blank portion between the second end of the second wire and the edge of the metal body part are each adjusted within a range of 5 mm to $\lambda_{(1)}\times0.5$ where $\lambda_{(1)}$ is an arbitrary wavelength in a free space within the frequency range.

19. The window glass structure according to claim 1, wherein the glass antenna has a circularly polarized wave reception band width to receive circularly polarized waves in multiple arbitrary frequency bands within the frequency range of 1 GHz to 2 GHz.

20. The window glass structure according to claim 1, wherein the metal body part is an A-pillar of the vehicle or a metal part of a window frame of the vehicle.

21. A glass antenna for receiving a circularly polarized wave in an arbitrary frequency band within a frequency range of 1 GHz to 2 GHz, the glass antenna being configured for mounting to a window glass of a vehicle, the glass antenna comprising:

a metal body part of the vehicle as an antenna element;

a core-side feeding part;

a ground-side feeding part arranged adjacent to the core-side feeding part;

a first element extending from the ground-side feeding part; and a parasitic element including a first wire, a second wire arranged parallel to the first wire and a third wire connecting the first wire and the second wire to each other, wherein the parasitic element is disposed to surround the core-side and ground-side feeding parts at a position between an edge of the metal body part located adjacent to the core-side and ground-side feeding parts and the third wire;

wherein the core-side feeding part is disposed in an area surrounded by the first wire, the third wire, the first element, the ground-side feeding part and the edge of the metal body part;

wherein a first blank portion where no antenna element exists is provided between the parasitic element and the first element such that the parasitic element and the first element allow resonance with a radio wave in any arbitrary frequency band within the frequency range;

wherein, when the window glass is mounted to the vehicle, a first end of the first wire located away from the third wire and the edge of the metal body part are disposed with a second blank portion where no antenna element exists being provided therebetween in an in-plane direction of the window glass of the vehicle such that the first end of the first wire and the metal body part are in a positional relationship that allows resonance with a radio wave in any arbitrary frequency band within the frequency range;

a second end of the second wire located away from the third wire and the edge of the metal body part are disposed without a blank portion where no antenna element exists being provided therebetween in the in-plane direction of the window glass of the vehicle, or are disposed with a third blank portion where no antenna element exists being provided therebetween in the in-plane direction of the window glass of the vehicle such that the second end of the second wire and the metal body part are in a positional relationship that allows resonance with a radio wave in any arbitrary frequency band within the frequency range; and a fourth blank portion where no antenna element exists is provided between the ground-side feeding part and the metal body part of the vehicle such that the ground-side feeding part and the metal body part of the vehicle allow resonance a radio wave in any arbitrary frequency band within the frequency range;

wherein the parasitic element has a detour wire formed in a bent shape and arranged in an area surrounded by the first wire, the second wire and the third wire;

wherein starting and end points of the detour wire are disposed on a route of a minimum distance between the first connection point and the second connection point, a minimum distance between the first connection point and the first end and a minimum distance between the second connection point and the second end; and wherein the starting and end points are in a positional relationship that allows resonance with a radio wave in any arbitrary frequency band within the frequency range.

* * * * *